US006679062B2

(12) United States Patent
Conete et al.

(10) Patent No.: US 6,679,062 B2
(45) Date of Patent: Jan. 20, 2004

(54) ARCHITECTURE FOR A COMBUSTION CHAMBER MADE OF CERAMIC MATRIX MATERIAL

(75) Inventors: Eric Conete, Merignac (FR); Alexandre Forestier, Boissise la Bertrand (FR); Didier Hernandez, Quiers (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/162,384

(22) Filed: Jun. 5, 2002

(65) Prior Publication Data

US 2002/0184891 A1 Dec. 12, 2002

(30) Foreign Application Priority Data

Jun. 6, 2001 (FR) ..... 01 07360

(51) Int. Cl.[7] ..... F02C 7/20
(52) U.S. Cl. ..... 60/796; 60/753; 60/800
(58) Field of Search ..... 60/752, 753, 796, 60/800, 799, 798

(56) References Cited

U.S. PATENT DOCUMENTS

| | | | | |
|---|---|---|---|---|
| 3,775,975 A | * | 12/1973 | Stenger et al. | 60/798 |
| 3,965,066 A | | 6/1976 | Sterman et al. | |
| 4,912,922 A | * | 4/1990 | Maclin | 60/796 |
| 5,291,732 A | | 3/1994 | Halila | |
| 5,335,502 A | * | 8/1994 | Roberts et al. | 60/752 |

* cited by examiner

*Primary Examiner*—Michael Koczo
(74) *Attorney, Agent, or Firm*—Oblon, Spivak, McClelland, Maier & Neustadt, P.C.

(57) ABSTRACT

A turbomachine comprises an annular shell of metal material containing in a gas flow direction F a fuel injection assembly, an annular combustion chamber of composite material, and an annular nozzle of metal material forming the fixed-blade inlet stage of a high pressure turbine, said nozzle being supported by the annular shell and being fixed thereto by first releasable fixing means, and provision being made for the combustion chamber to be mounted in floating manner inside the annular shell and held in position solely by the nozzle to which it is fixed in resilient manner by second releasable fixing means.

10 Claims, 3 Drawing Sheets

ARCHITECTURE FOR A COMBUSTION CHAMBER MADE OF CERAMIC MATRIX MATERIAL

FIELD OF THE INVENTION

The present invention relates to the field of turbomachines, and more particularly it relates to the interface between the high pressure turbine and the combustion chamber in turbojets that are fitted with a combustion chamber made of ceramic matrix composite (CMC).

PRIOR ART

Conventionally, in a turbomachine, the high pressure turbine (HPT) and in particular its inlet nozzle, the combustion chamber, and the casing (or shell) of said chamber are all made of the same material, generally of the metal type. However, under certain particular conditions of use, implementing very high temperatures, a combustion chamber made of metal can be completely unsuitable from a thermal point of view and it is necessary to use a chamber made of high temperature composites of the CMC type. Nevertheless, the difficulties of working such materials and the expense thereof mean that use of such materials is usually limited to the combustion chamber itself, with the high pressure turbine inlet nozzle and the casing then continuing to be made more conventionally out of metal materials. Unfortunately, metal materials and composite materials have coefficients of thermal expansion that are very different. This gives rise to particularly severe interface problems with the nozzle at the inlet of the high pressure turbine and connection problems with the casing of the chamber.

OBJECT AND BRIEF SUMMARY OF THE INVENTION

The present invention mitigates these drawbacks by proposing a casing-chamber connection having the ability to absorb the displacements caused by the differences between the expansion coefficients of those parts. An object of the invention is thus to propose a structure of simple shape that is particularly easy to manufacture.

These objects are achieved by a turbomachine comprising a shell of metal material containing along a gas flow direction F: a fuel injection assembly, a combustion chamber of composite material, and a nozzle of metal material forming the fixed-blade inlet stage of a high pressure turbine, said nozzle being supported by said shell and being fixed thereto by first releasable fixing means, wherein said combustion chamber is mounted in floating manner inside said shell and is held in position solely by said nozzle to which it is fixed in resilient manner by second releasable fixing means.

By this direct connection (integration) of the combustion chamber and the nozzle, without any connection with the shell, manufacture of said chamber is considerably simplified, while simultaneously greatly improving sealing between the chamber and the nozzle. In addition, the resulting good alignment of the gas stream in operation enables the high pressure turbine to be fed more effectively. Eliminating the usual flanges of the combustion chamber (for connection to the shell) also achieves an appreciable saving in weight for said chamber and thus for the turbomachine.

By integrating the nozzle with the chamber, problems of relative displacement between the chamber and the shell are transferred to the nozzle, and provision is made for the first releasable fixing means to be adapted to enable said nozzle to expand freely in a radial direction relative to the shell.

In a preferred embodiment, said second releasable fixing means comprise firstly first holding means for holding an inner axially-extending wall at the end of said combustion chamber clamped between an inner circular platform of the nozzle and a flange serving to support an inner annular wall of said shell, and second holding means for holding an outer axially-extending wall at the end of said combustion chamber with resilient prestress against an outer circular platform of the nozzle.

Preferably, said support flange is subdivided into sectors to compensate for circumferential geometrical differences that result from the differential expansions that exist at high temperatures between said inner circular platform of the nozzle and said inner axially-extending wall of the combustion chamber. Said support flange is mounted between a flange of said inner annular wall of the shell and a ring of metal material held against said flange by said first releasable fixing means.

Advantageously, said first releasable fixing means comprise a plurality of bolts with the screw shanks thereof that pass through respective corresponding oblong holes of said support flange being provided with respective shoulders against which said ring is caused to bear so as to enable said support flange to slide between said ring and said flange of the inner annular wall of the shell.

In order to provide sealing for the turbomachine, said flange of the inner annular wall of the shell has a circular groove for receiving an omega type circular sealing gasket for providing sealing between said flange of the inner annular wall of the shell and said support flange. Likewise, a composite material ring advantageously brazed on said outer end wall of the combustion chamber is held with resilient prestress against said outer circular platform of the nozzle by the second holding means, said ring having a circular groove for receiving a circular sealing gasket of the omega type for providing sealing between said outer end wall of the combustion chamber and said circular outer platform of the nozzle.

BRIEF DESCRIPTION OF THE DRAWINGS

The characteristics and advantages of the present invention appear better from the following description made by way of non-limiting indication and with reference to the accompanying drawings, in which.

DETAILED DESCRIPTION OF A PREFERRED EMBODIMENT

Figure 1:
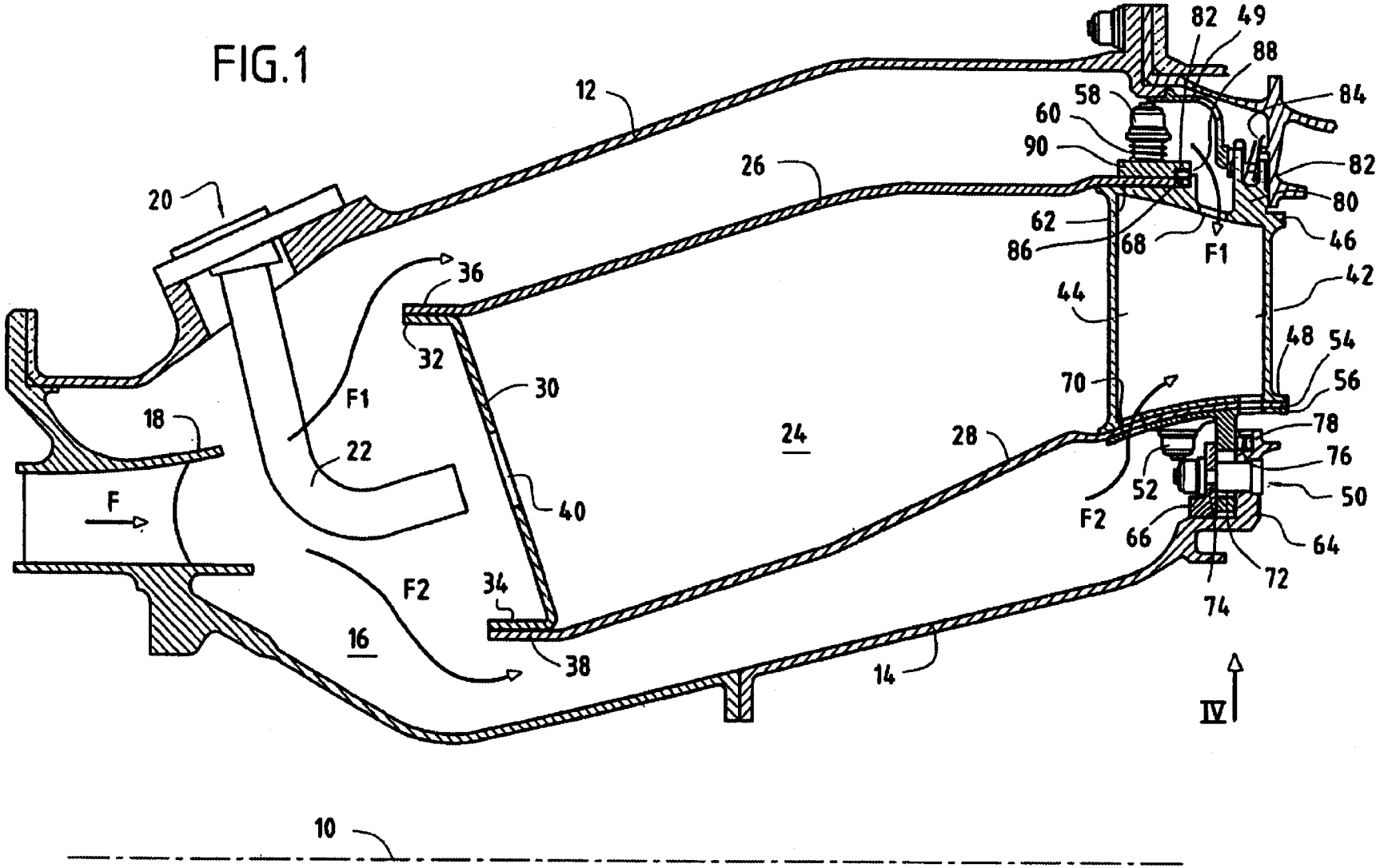
FIG. 1 is a diagrammatic axial half-section of a central portion of a turbomachine.
Figure 2:
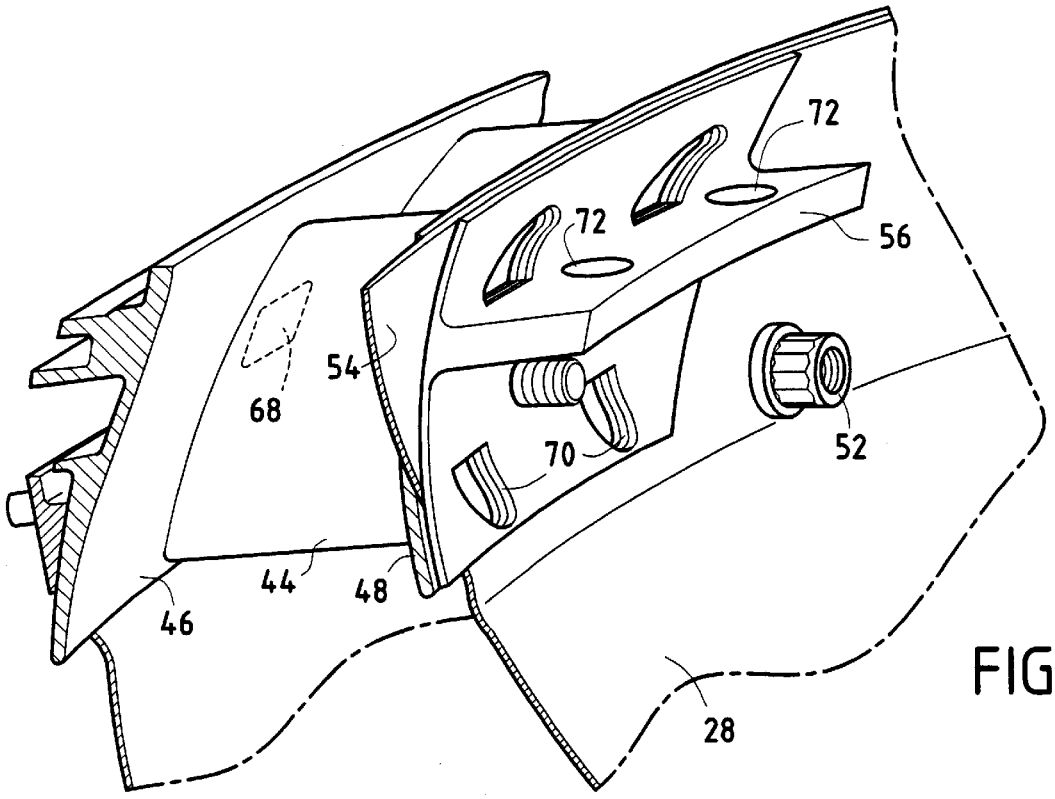
FIG. 2 is a detailed perspective view of the connection between the high pressure turbine and the combustion chamber via the inner platform of the nozzle.
Figure 3:
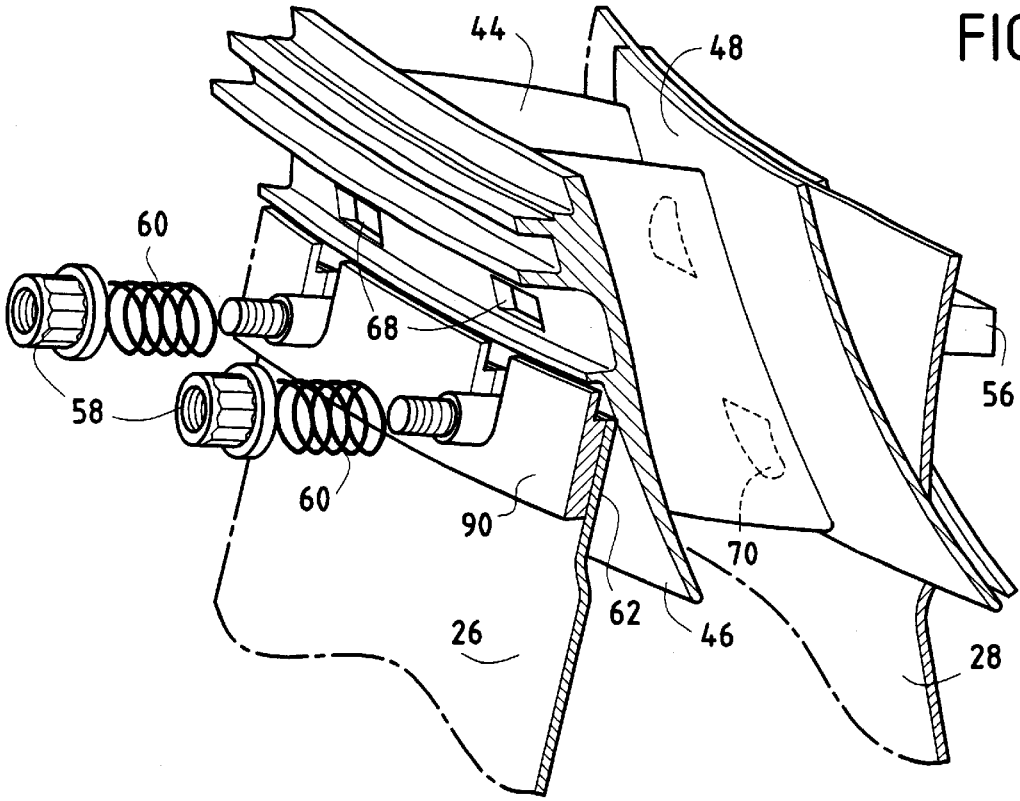
FIG. 3 is a detailed perspective view of the connection between the high pressure turbine and the combustion chamber via the outer platform of the nozzle.
Figure 4:
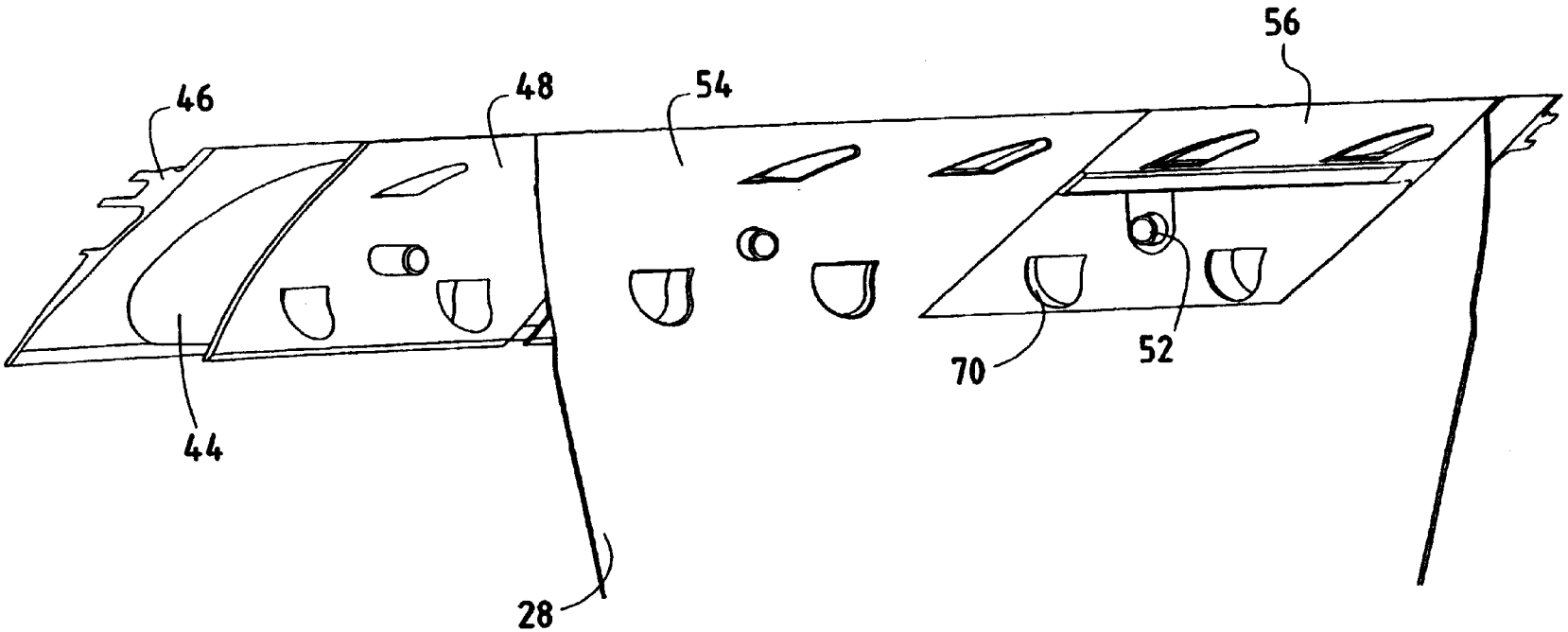
FIG. 4 is a view looking along line IV of FIG. 1.

FIG. 1 is an axial half-section showing a central portion of a turbojet or a turboprop (referred to generically as a "turbomachine" in this specification) comprising:

a shell having an outer annular wall (or outer casing) 12 of metal material having a longitudinal axis 10, and an inner annular wall (or inner casing) 14 coaxial therewith and likewise made of metal material; and an annular space 16 lying between the two annular walls 12, 14 of the shell and receiving the compressed oxidizer, generally air, coming from an upstream compressor (not shown) of the turbomachine via an annular diffusion duct 18 defining a general gas flow direction F.

In the gas flow direction, this space 16 contains firstly an injection assembly formed by a plurality of injection systems 20 regularly distributed around the duct 18 and each comprising a fuel injection nozzle 22 fixed to the outer annular casing 12 (in order to simplify the drawings, the mixer and the deflector associated with each injection nozzle are not shown), followed by a combustion chamber 24 made of high temperature composite material of the CMC type or of some other like type (e.g. carbon), formed by an outer axially-extending side wall 26 and an inner axially-extending side wall 28, both disposed coaxially about the axis 10, and a transversely-extending end wall 30 having margins 32, 34 fixed by any suitable means, (e.g. metal or refractory bolts with flat heads) to the upstream ends 36, 38 of the side walls 26, 28, said end wall 30 being provided with orifices 40 to allow fuel and a fraction of the oxidizer to be injected into the combustion chamber 24, and finally an annular nozzle 42 made of metal forming an inlet stage for a high pressure turbine (not shown) and conventionally comprising a plurality of fixed blades 44 mounted between an outer circular platform 46 and an inner circular platform 48. The nozzle rests on support means 49 secured to the annular shell of the turbomachine and it is fixed thereto by first releasable fixing means preferably constituted by a plurality of bolts 50.

In the invention, the combustion chamber is mounted in floating manner inside the annular shell and is held in position solely by the nozzle to which it is fixed in resilient manner by second releasable fixing means comprising firstly first holding means 52 for clamping onto an inner axially-extending side wall portion 54 at the end of the combustion chamber (remote from its upstream end 38) between the inner circular platform 48 of the nozzle and a flange 56 serving as a support for the inner annular shell 14, and second holding means 58 for holding an outer axially-extending side wall portion 62 at the end of said combustion chamber that is remote from its upstream end 36 with resilient prestress 60 against the outer circular platform 46 of the nozzle. The support flange 56 is mounted between a flange 64 of the inner annular shell 14 and a metal ring 66 held against said flange by the first releasable fixing means 50.

Through orifices 68, 70 for passing compressed oxidizer as previously separated at the outlet of the diffusion duct 18 into at least two distinct flows F1 and F2 traveling on either side of the combustion chamber 24 (and serving in particular to cool it) are formed through the outer and inner metal platforms 46 and 48 of the nozzle 42 so as to cool the fixed blades 44 of the nozzle at the inlet to the high pressure turbine of the rotor.

Since the combustion chamber 24 has a coefficient of thermal expansion that is very different from that of the other parts making up the turbomachine since they are made of metal, and in particular a coefficient of expansion that is very different from that of the nozzle 42 to which it is fixed and from that of the annular shell 12, 14, provision is made for the first releasable fixing means 50 to be adapted to enable the nozzle to expand freely at high temperature in a radial direction relative to the annular shell. To do this, the support flange 56 is pierced by oblong holes 72 for co-operating with the screw shanks of a plurality of bolts 50 having a shoulder 74 for bearing against the ring 66 so as to allow the support flange to slide between the ring and the flange 64 of the inner annular shell 14. In addition, this flange is subdivided into sectors to compensate for the circumferential geometrical differences that result from the differential expansion that exists at high temperatures between the inner circular platform 48 of the nozzle and the inner axially-extending wall 28, 54 of the combustion chamber.

In order to seal the flow of gas between the combustion chamber and the turbine, the flange 64 of the inner annular shell has a circular groove 76 for receiving an omega type circular gasket 78 for providing sealing between this flange of the inner annular shell and the support flange 56. In this way, the flow of compressed oxidizer coming from the compressor and surrounding the chamber via F2 can penetrate into the turbine only through the orifices 70. Similarly, the outer circular platform 46 of the nozzle has a flange 80 provided with a circular groove 82 for receiving a spring blade gasket 84 having one end which comes into contact with the outer annular shell 12 so as to provide sealing relative to the flow F1.

The sealing between the combustion chamber 24 and the nozzle 42 is provided between the outer wall 62 at the end of the combustion chamber and the outer circular platform 46 of the nozzle likewise by means of an omega type circular gasket 86 mounted in a circular groove 88 of a composite material ring 90 advantageously brazed to the outer wall 62 at the end of the combustion chamber and held with resilient prestress (e.g. obtained by the spring 60) against the outer circular platform 46 of the nozzle by the second holding means 58.

What is claimed is:

1. A turbomachine comprising a shell of metal material containing along a gas flow direction F: a fuel injection assembly, a combustion chamber of composite material, and a nozzle of metal material forming the fixed-blade inlet stage of a high pressure turbine, said nozzle being supported by said shell and being fixed thereto by first releasable fixing means, wherein said combustion chamber is mounted in floating manner inside said shell and is held in position solely by said nozzle to which it is fixed in resilient manner by second releasable fixing means.

2. A turbomachine according to claim 1, wherein said first releasable fixing means are adapted to enable said nozzle to expand freely in a radial direction relative to said shell.

3. A turbomachine according to claim 1, wherein said second releasable fixing means comprise firstly first holding means for holding an inner axially-extending wall at the end of said combustion chamber clamped between an inner circular platform of the nozzle and a flange serving to support an inner annular wall of said shell, and second holding means for holding an outer axially-extending wall at the end of said combustion chamber with resilient prestress against an outer circular platform of the nozzle.

4. A turbomachine according to claim 3, wherein said support flange is subdivided into sectors to compensate for circumferential geometrical differences that result from the differential expansions that exist at high temperatures between said inner circular platform of the nozzle and said inner axially-extending wall of the combustion chamber.

5. A turbomachine according to claim 3, wherein said support flange is mounted between a flange of said inner annular wall of the shell and a ring of metal material held against said flange by said first releasable fixing means.

6. A turbomachine according to claim 5, wherein said first releasable fixing means comprise a plurality of bolts with the screw shanks thereof that pass through respective corresponding oblong holes of said support flange being provided with respective shoulders against which said ring is caused to bear so as to enable said support flange to slide between said ring and said flange of the inner annular wall of the shell.

7. A turbomachine according to claim 6, wherein said flange of the inner annular wall of the shell has a circular groove for receiving an omega type circular sealing gasket for providing sealing between said flange of the inner annular wall of the shell and said support flange.

8. A turbomachine according to claim 3, further comprising a composite material ring advantageously brazed to said outer wall at the end of the combustion chamber and held with resilient prestress against said outer circular platform of the nozzle by said second holding means.

9. A turbomachine according to claim 8, wherein said ring has a circular groove for receiving an omega type circular sealing gasket for providing sealing between said outer wall at the end of the combustion chamber and said outer circular platform of the nozzle.

10. A turbomachine comprising an outer annular shell and an inner annular shell defining between them a space for receiving in succession in the gas flow direction F: firstly an annular combustion chamber of composite material formed by an outer axially-extending side wall, an inner axially-extending side wall, and a transversely-extending end wall, and secondly an annular nozzle subdivided into sectors and made of a metal material comprising a plurality of fixed blades mounted between an outer axially-extending platform and an inner axially-extending platform, wherein the free end portions of said outer and inner axially-extending side walls of the combustion chamber are connected to said outer and inner platforms of said nozzle, said inner axially-extending side wall portion at the end of the chamber being clamped by means of first holding means between said inner platform of the nozzle and a flange serving as a support for said inner annular shell, and said outer axially-extending side wall portion at the end of the chamber being held with resilient prestress against said outer platform of the nozzle by second holding means.

* * * * *